US009310151B2

(12) United States Patent
Köster et al.

(10) Patent No.: US 9,310,151 B2
(45) Date of Patent: Apr. 12, 2016

(54) INSERTION TUBE FOR FIRING SUB-CALIBER AMMUNITION BODIES AND WEAPON COMPRISING AN INSERTION TUBE

(75) Inventors: Jens Köster, Kassel (DE); Matthias Raczek, Kassel (DE); Bernd Wagner, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 14/119,422

(22) PCT Filed: May 22, 2012

(86) PCT No.: PCT/DE2012/100150

§ 371 (c)(1),
(2), (4) Date: Feb. 14, 2014

(87) PCT Pub. No.: WO2012/159624

PCT Pub. Date: Nov. 29, 2012

(65) Prior Publication Data

US 2014/0345180 A1 Nov. 27, 2014

(30) Foreign Application Priority Data

May 26, 2011 (DE) ..... 10 2011 050 635

(51) Int. Cl.
*F41A 21/10* (2006.01)
*F41A 3/10* (2006.01)
(Continued)

(52) U.S. Cl.
CPC . *F41A 21/10* (2013.01); *F41A 3/10* (2013.01); *F41A 9/42* (2013.01); *F41A 21/04* (2013.01); *F42B 30/10* (2013.01)

(58) Field of Classification Search
CPC ..... F41A 21/10; F41A 21/04; F41A 21/02; F41A 21/12; F41A 3/10
USPC ..... 89/14.05, 14.7, 14.8, 1.701, 1.702, 89/1.703, 1.704, 1.705, 1.706, 1.7, 1.8, 29, 89/30; 42/76.01, 76.02, 77, 78, 76.1, 59
See application file for complete search history.

(56) References Cited

U.S. PATENT DOCUMENTS 1,483,146 A * 2/1924 Wiley ..... F41C 27/06 42/105
2,863,394 A 12/1958 Losfeld
(Continued)

FOREIGN PATENT DOCUMENTS

DE 47962 7/1889
DE 7345054 12/1973
(Continued)

OTHER PUBLICATIONS

PCT, International Search Report and Written Opinion; Patent Application No. PCT/DE2012/100150 (Jan. 31, 2013).
(Continued)

*Primary Examiner* — Samir Abdosh
*Assistant Examiner* — John D Cooper
(74) *Attorney, Agent, or Firm* — Thompson Hine LLP

(57) ABSTRACT

An insertion tube (1) for firing sub-caliber ammunition bodies (20) using a high caliber weapon (10) is inserted into the loading chamber (11) of the weapon (10). The tube wall (2) of the insertion tube (1) has penetrating recesses (3) for compensating pressure differences between the inside of the insertion tube (1) and the loading chamber (11). A weapon includes an insertion tube (1) which can be inserted into the loading chamber (11) of the weapon (10) for firing a sub-caliber ammunition body (20), the insertion tube (1) being designed in the above-described manner.

20 Claims, 7 Drawing Sheets

(51) Int. Cl.

| | |
|---|---|
| ***F41A 9/42*** | (2006.01) |
| *F41A 21/04* | (2006.01) |
| *F42B 30/10* | (2006.01) |

(56) References Cited

U.S. PATENT DOCUMENTS

| | | | | |
|---|---|---|---|---|
| 4,633,755 | A | 1/1987 | Bertiller et al. | |
| 4,644,930 | A * | 2/1987 | Mainhardt | F41A 11/02 124/58 |
| 4,648,192 | A * | 3/1987 | Harness | F41A 21/10 42/75.04 |
| 5,415,074 | A * | 5/1995 | Fields | F41A 21/10 42/77 |
| 5,666,756 | A * | 9/1997 | Moller | F41A 21/10 42/47 |
| 5,937,563 | A * | 8/1999 | Schuetz | F41A 21/10 42/106 |
| 6,202,533 | B1 * | 3/2001 | Reynolds | F41A 21/10 89/14.5 |
| 7,062,875 | B1 * | 6/2006 | Stevens | F41A 21/10 42/77 |

FOREIGN PATENT DOCUMENTS

| | | |
|---|---|---|
| DE | 3321233 | 12/1984 |
| GB | 767487 | 2/1957 |

OTHER PUBLICATIONS

PCT, International Preliminary Report on Patentability; Patent Application No. PCT/DE2012/100150 (Nov. 26, 2013).

* cited by examiner

INSERTION TUBE FOR FIRING SUB-CALIBER AMMUNITION BODIES AND WEAPON COMPRISING AN INSERTION TUBE

The instant application should be granted the priority dates of May 26, 2011, the filing date of the corresponding German patent application 10 2011 050 635.7, as well as May 22, 2012 the filing date of the International patent application PCT/DE2012/100150.

BACKGROUND OF THE INVENTION

The invention relates to an insertion tube for firing subcaliber ammunition bodies with a high caliber weapon, which is insertable in the loading chamber of the weapon. Further subject matter of the invention forms a weapon with an insertion tube, which is insertable into the loading chamber of the weapon for firing subcaliber ammunition bodies.

Guns with larger caliber weapons, such as artillery, howitzers, etc., are usually operated with split ammunition consisting of the actual projectile and a separate propellant charge. When loading the weapon, first the projectile is inserted and next the propellant charge is inserted from behind through an opened closure device into the loading chamber of the weapons. Upon positioning of the projectile into the loading chamber of the weapon projecting in the firing direction, the projectile adapted to the caliber of the weapon is displaced securely within the loading chamber and closes this in a gas-tight manner on the opening side. After closing of the closure device, the propellant charge can be ignited and the projectile can be fired, whereby upon ignition of the propellant charge, the gas pressure that is provided also can be used in order to close the loading chamber in a gas-tight manner also on the loading side via a sealing element that is effective under pressure effects, often designated as a obturator.

In addition to these specific applications of the weapon, in many situations it also is desired to fire subcaliber ammunition bodies, that is ammunition bodies with a smaller caliber than that of the weapon. For example, in the frame of maneuvers, based on reasons of costs, frequently practice ammunition of a smaller caliber are used, which cannot be fired readily in any event by means of the high caliber weapon.

In this connection, it is known to reduce the caliber of the weapon by means of an insertion tube, which is insertable in the loading chamber of the weapon, in order to temporarily adapt to a smaller caliber of the practice ammunition, which enables the practice ammunition to assume a defined position within the loading chamber and to be fired accurately.

Such insertion tubes for firing practice ammunition typically are smooth-walled tubes, which are well-proven for firing cartridge practice ammunition. The practice ammunition typically consists of a projectile and a propellant charge arranged behind the projectile in a common cartridge housing, which is why upon firing of the practice ammunition, a gas pressure is produced by the cartridge housing in the direction of the opening-side of the weapon, via which the projectile is accelerated out of the cartridge housing.

Problems occur, however, when firing other types of subcaliber ammunition bodies, for example, when firing mortar cartridges, with which a gas pressure forms within the loading chamber of the weapon, which is also directed in the direction of the closure side of the weapon. Because the insertion tube inserted in the loading chamber is typically provided in the closure area of the weapon, sealing elements shield the loading chamber from the effects of pressure. With such ammunition bodies, the danger exists that upon ignition for a mortar cartridge, for example, the sealing element of the loading chamber is not sealed effectively and parts of the gas pressure produced during firing of the weapon move rearwardly.

SUMMARY OF THE INVENTION

The object of the invention, therefore, is to provide an insertion tube as well as a weapon, with which the various type of subcaliber ammunition bodies can be fired with greater security.

This object is solved with an insertion tube of the above-noted type by means of recesses penetrating through the tube wall of the insertion tube for compensation of pressure differences between the interior of the insertion tube and the loading chamber.

By means of the recesses penetrating the tube wall of the insertion tube, gas pressures produced during firing of the ammunition body can be conducted from the interior of the insertion tube into the loading chamber, in which these are then available for sealing the loading chamber via the corresponding sealing element. The danger that the function of the sealing element is impaired by the insertion tube and any parts of the pressure itself move rearwardly over the closure of the weapon upon firing of the subcaliber mortar cartridge is substantially reduced.

One embodiment of the invention contemplates that the recesses extend radially outward from the interior of the tube wall. Preferably, the recesses are provided in the lading-side end region of the insertion tube.

In this connection, according to a further embodiment, it is advantageous if the recesses extend at an acute angle relative to the axis of the insertion tube, whereby the gas pressures produced upon firing are transferred at a corresponding angle onto the sealing element and a reliable sealing action of the sealing element is achievable. It was noted that it is particularly advantageous if the angle lies in the range of 10° and 50° and in particular, lies in the range of 20° to 40° or in the range of 25° to 35°.

Furthermore, it is advantageous if the recesses extend at least partially into a front face of the tube wall, whereby a favorable transfer of the pressure on the sealing element arranged in the loading-side end region of the loading chamber can be achieved.

A further embodiment contemplates that the recesses run in a front-face edge of the insertion tube.

An embodiment in which the recesses are formed as a type of through-bores is of advantage in a manufacturing sense. The through-bores can be applied in the insertion tube, for example, by means of machining manufacturing methods.

For uniform pressure compensation, it is advantageous if multiple bores are distributed symmetrically over the circumference of the tube wall.

In addition, it is an object of the present invention to provide a weapon of the above-mentioned type, in which the insertion tube is formed in the previously described manner.

By means of the recesses penetrating the tube wall of the insertion tube inserted in the weapon, the gas pressures produced upon firing of the ammunition body are conducted from the interior of the insertion tube into the loading chamber of the weapon, in which these are made available for sealing the loading chamber via the corresponding sealing element. The risk that the function of the closure-side sealing element is impaired by the insertion tube and any pressure components themselves move outwardly over the closure of the weapon when a subcaliber mortar cartridge is fired is substantially reduced.

One embodiment of the weapon contemplates that the loading chamber is closeable via a closure element, whereby between the closure element and the loading chamber, a sealing element is arranged, which is formed such that this seals the loading chamber under the effects of pressure relative to the closure element. Such sealing elements often are known in the field of large caliber weapons as obturators. Based on the pressure transfer from the interior of the insertion tube into the loading chamber, and therewith, onto the sealing element, it is not necessary to provide another sealing element when firing a subcaliber ammunition body as this is provided during firing of ammunition of corresponding nominal caliber.

In consideration of a reliable pressure transfer onto the sealing element, it is proposed according to a further embodiment that the recesses extend in the direction of the sealing element. In this manner, the gas pressure produced when firing the sub-caliber ammunition body is conducted in a direct path in the direction of the sealing element, so that this is reliably sealed.

For release of the ammunition body, it is structurally advantageous if the closure element has a firing pin bushing, through which a firing pin can be guided for igniting the ammunition body.

In order to enable automatic loading of the weapon, a further embodiment contemplates that a loading device for inserting an ammunition body in the interior of the insertion tube inserted in the loading chamber is provided.

In this connection, it is advantageous if the loading device has a feed slider that is moveable in the direction of the tube bore axis of the weapon for supplying the ammunition body from a delivery position into a firing position in the interior of the loading chamber of the weapon. Via the feed slider, the ammunition body can be displaced from a delivery position outside of the loading chamber into a firing position within the loading chamber of the weapon.

A particularly advantageous embodiment contemplates that the feed slider holding the ammunition body in its firing position is formed to be moveable in a second direction. This is based on the fact that with firing of subcaliber ammunition bodies, the danger exists that they will slide out of the loading chamber when using an elevated weapon, before the loading chamber is closed via the closure element. Since the feed slider holds the ammunition body in its firing position and simultaneously is formed to be moveable in a further direction, this can be moved away simultaneously upon closing of the loading chamber by the closure element, without the ammunition body losing its secure hold within the loading chamber, until this holding function is taken over by the closure element.

Of structural advantage is an embodiment in which the feed slider is formed to be moveable against the force of a spring in the second direction. By removing the tension of the spring, the feed slider can subsequently restore the feed slider automatically into a starting position.

Further advantageous from a structural perspective is an embodiment, according to which the feed slider is formed to be linearly moveable in a second direction. In this connection, it is structurally advantageous if the movements of the feed slider in the second direction are guided via a linear guide formed as a pin or bolt guide.

In a further embodiment of the invention, it is proposed that the loading device has a charge cradle for receiving the ammunition body. The charge cradle can be a half-shell shaped, cylindrical receiving element, on which the ammunition body is placed from above and subsequently can be displaced via the feed slider into the direction of the loading chamber.

It is advantageous if the charge cradle is connected on its weapon-side end with a charge cradle flap. In this manner, the charge cradle or the charge cradle flap lengthening the charge cradle can directly reach the opening of the loading chamber of the weapon and the charge cradle flap then can flap away upon closing of the loading chamber by means of the closure element.

In this connection, it is further advantageous if the charge cradle flap is formed to be pivotable against the force of a spring relative to the charge cradle. By removing the tension of the spring, the charge cradle flap can be automatically pivoted back into its starting position that is flush with the charge cradle.

A further embodiment contemplates that the loading device is mountable via a fastening element to the weapon. The fastening element can be a fastening flange, for example, via which the loading device is mountable with minimal hand movement to the weapon. By mounting the loading device to the weapon, this is adjustable jointly with the weapon.

Finally, a further embodiment of the weapon proposes that its loading chamber is closeable via a closure element, whereby the movements of the feed slider are initiated along the second direction and/or the pivoting motions of the charge cradle flap are initiated by movement of the closure element. It is not necessary to initiate the movements of the feed slider along the second direction or the flap motion of the charge cradle flap, for example, via a corresponding drive. For this movement, the movement of the closure element can be used, whereby an overall more simple structure is provided.

BRIEF DESCRIPTION OF THE DRAWINGS

Further details and advantages of the invention will be explained next with reference to the accompanying drawings of an exemplary embodiment. In the drawings.

DETAILED DESCRIPTION OF SPECIFIC EMBODIMENTS

Figure 1:
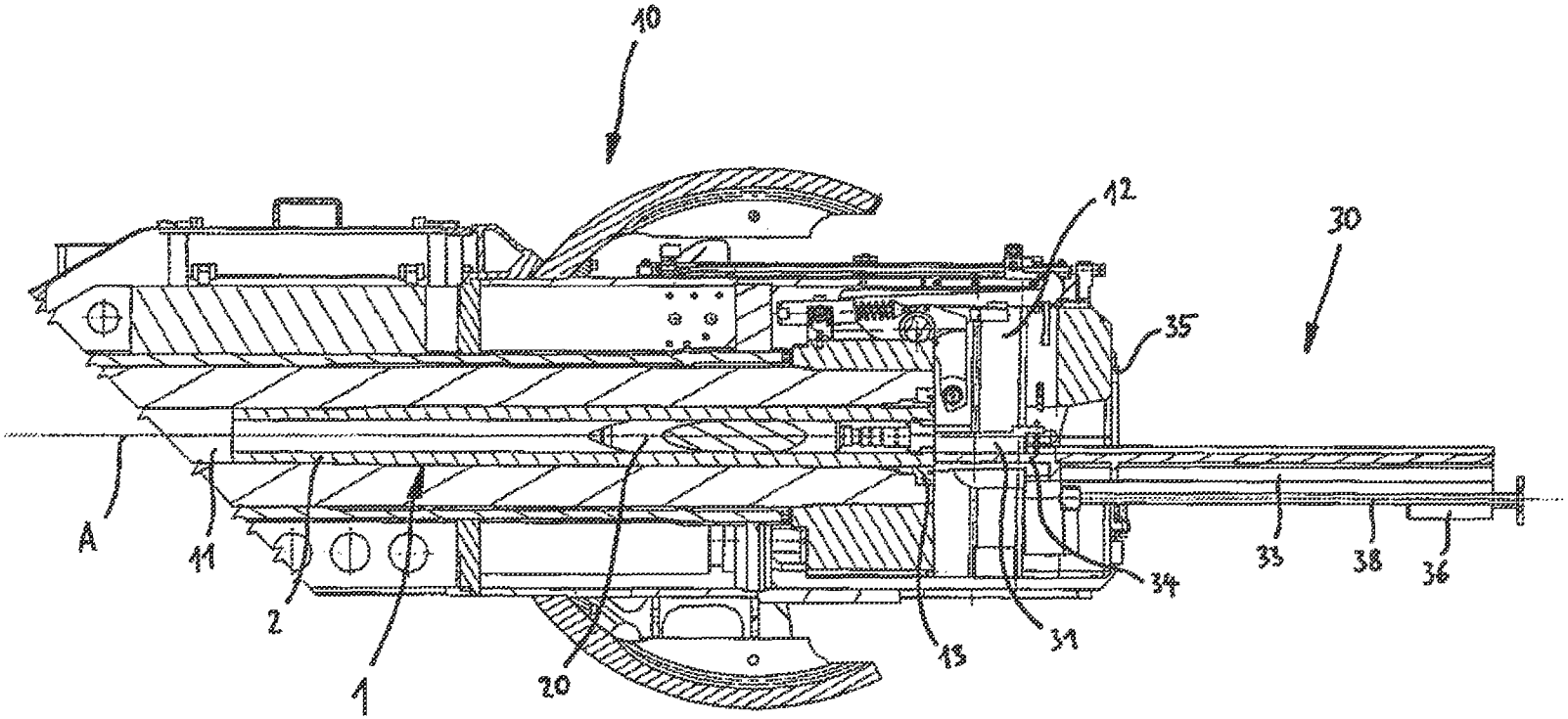
FIG. 1 shows a side sectional view of the loading-side end of a weapon with a loading device for loading the weapon with a subcaliber ammunition body.

The loading-side end of a large-caliber weapon 10 is shown in FIG. 1, which is loaded with an ammunition body 20 in cartridge form having a small caliber.

The weapon 10 in the exemplary embodiment is part of a self-propelled gun, whereby the loading-side end of the weapon 10 projects into the inner chamber of the howitzer that is protected against militaristic threats. Typically, such a weapon 10 or the correspondingly dimensioned ammunition bodies engage targets with a distance greater than 3.9 km.

A subcaliber ammunition body 20 acts as a mortar round, by means of which also targets located closer to the firing point can be engaged. Typically, with these types of mortar rounds, targets with a distance of 0.5 to 6 km from the firing point are engaged. In this connection, a mortar troop made up of at most three people sets up a tripod that supports a mortar tube, into which the mortar cartridges then are thrown by hand on the opening-side and are then ignited via a fuse. The disadvantage with this type of firing of mortar rounds is that the mortar troops must stand in the open, unprotected from adversarial threats, for example, snipers.

As shown in FIG. 1, the subcaliber ammunition body 20 is received in an insertion tube 2 inserted into the loading chamber 11 of the weapon 10, which serves for caliber compensation between the ammunition body 20 and the loading chamber 11. For insertion of the ammunition body 20 from an attachment position lying outside of the loading chamber 11 in the firing position shown in FIG. 1, a loading device 30 is provided.

With the assistance of the insertion tube 1 as well as with the help of the loading device 30, it is possible in a simple manner to make available large-caliber weapons 10 for firing subcaliber ammunition bodies 20 such as mortar rounds, so that the weapons 10 also can be used for engaging targets in the surrounding area of the weapon 10. Thus, it is not necessary for the shooter to leave the interior of the howitzer that is protected against ballistic and blast effects.

Details of the insertion tube 1 and the loading device 30 will be discussed in detail below.

Figure 2:
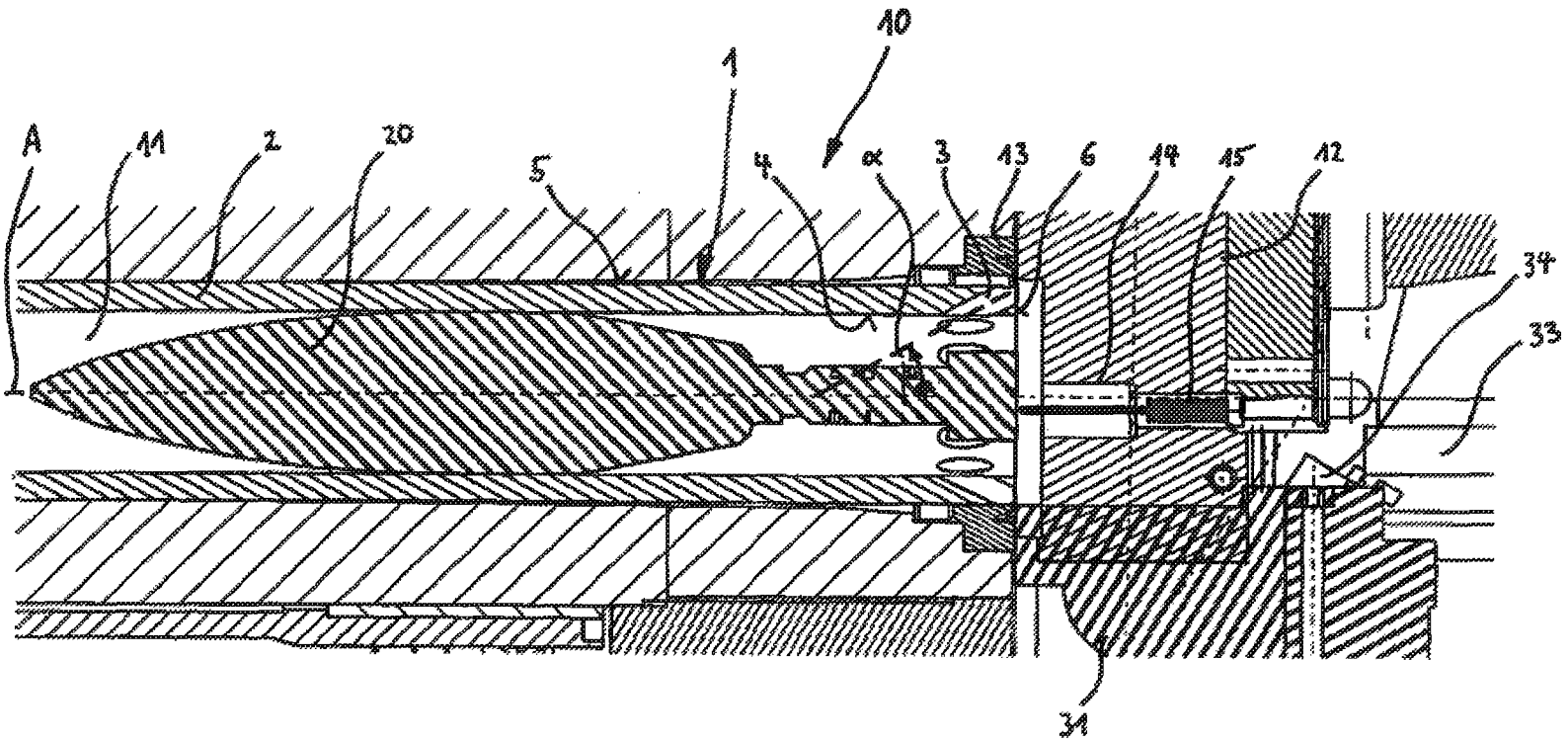
FIG. 2 shows an enlarged partial view of the loading-side end of a weapon according to the representation in FIG. 1.

As shown in the enlarged representation of FIG. 2, the insertion tube 1 is inserted into the loading chamber 11 of the weapon 10, such that this flush with the loading chamber 11. In the loading-side end region, the loading chamber 11 of the weapon 10 is widened and is provided with a sealing element 13, which radially surrounds the insertion tube 1. The sealing element 13 is an obturator 13, which seals the loading chamber 11 as a result of a pressure increase in the loading chamber 11 against the closure element 12 formed as a locking piece.

In the interior of the insertion tube 1, the subcaliber ammunition body 20 can be seen, which is a mortar cartridge. The mortar cartridge 20 is ignited via a firing pin 15, which is guided via a firing pin bushing 14 through the closure element 12. Upon actuation of the firing pin 15, the ammunition body 20 is ignited, whereby a massive pressure increase occurs within the insertion tube 1. This pressure is conducted via multiple recesses 3 in the direction of the sealing element 13, so that this seals the loading chamber 11 gas-tight against the closure element 12 and no gas parts can escape into the direction of the interior of the howitzer.

Figure 5:
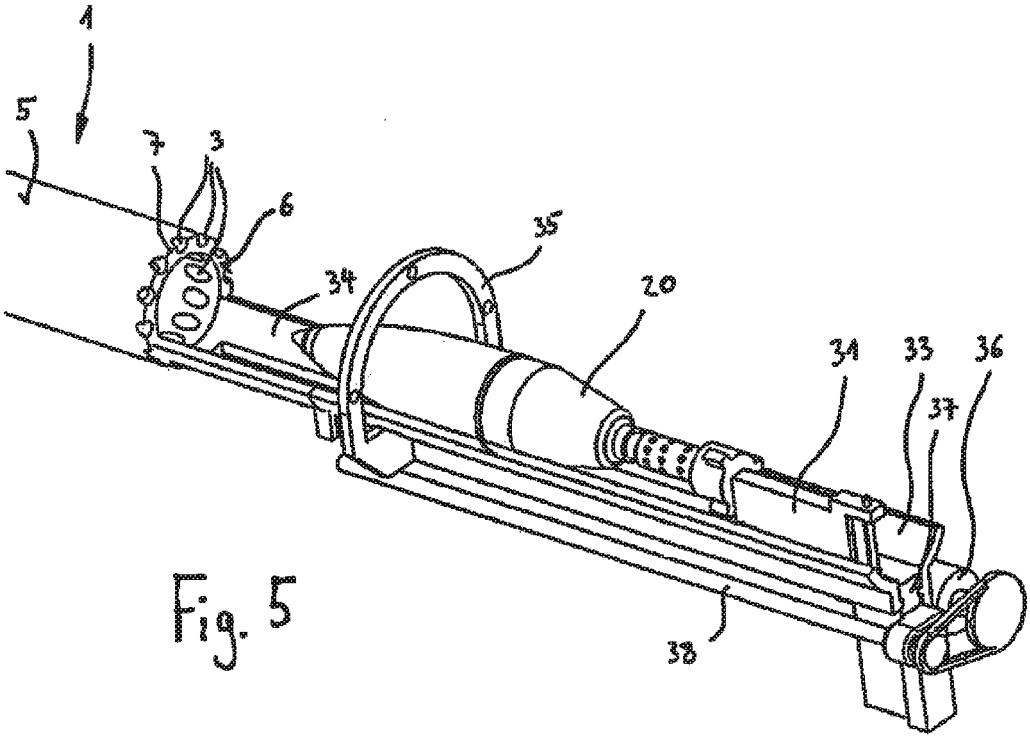

As further shown in FIG. 2, the recesses 3 extend as a type of through-bores from the inside 4 of the insertion tube 1 through its tube wall 2 to the outside 5. In connection with the illustration in FIG. 5, it is clearly that the recesses 3 terminate in the front face 6 of the insertion tube 1 as well as in its outer side 5. The edge 7 is penetrated in selected points by the recesses 3.

The recesses 3 are distributed symmetrically over the circumference of the insertion tube 1 and extend at an acute angle $\alpha$ relative to the axis A of the insertion tube 1 in the direction of the sealing element 13. With one embodiment, the angle $\alpha$ amounts to approximately 30°. Depending on the structure of the sealing element 13, it is also advantageous if the angle $\alpha$ is in the range of 25° to 35°, 20° to 40° or 10° to 50°.

Next, the details of the loading device 30 will be explained.

Figure 3:
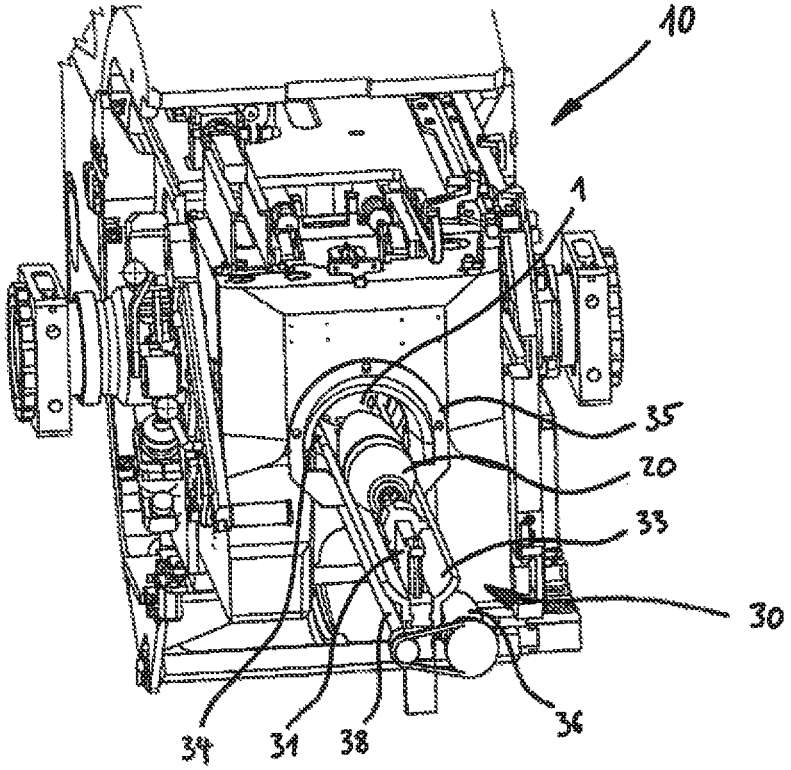
FIG. 3 shows a perspective view of the charge-side end of a weapon.

FIG. 3 shows in perspective view the loading-side end of the weapon 10. In the region of a floor piece of the weapon 10, the loading device 30 is attached to the weapon 10 via a fastening element 35 formed as an attachment flange, which surrounds the loading chamber 11 in a horseshoe shape. The loading device 30 is adjustable jointly with the weapon 10 in azimuth as well as in elevation; that is, the loading device 30 is always located in a position that is flush with the tube bore axis of the weapon 10, independent from the adjustment movements of the weapon 10.

The loading device 30 has a charge cradle 33 for receiving an ammunition body 20. A feed slider 31, which is driven via a motorized drive 36 and a spindle drive 38, is disposed approximately in the center of the charge cradle 33. By means of the feed slider 31, the ammunition body 20 can be displaced from a feed position outside of the weapon 10 into the direction of the tube bore axis into a firing position in the interior of the loading chamber 11 of the weapon 10. Near the loading chamber 11 of the weapon 10, the charge cradle 33 has a charge cradle flap 34 that is downwardly moveable. In addition, the feed slider 31 is moveable in this region in a direction transverse to the feed direction of the ammunition body 20, whereby next, a loading and firing process of a subcaliber ammunition body 20 will be set forth in detail.

In a first step, first the insertion tube 1 is inserted through the open closure 12 into the loading chamber 11 of the weapon 10. In the next step, the loading device 30 is fixed via the fastening element 35, formed as a horseshoe-shaped flange, to the loading-side end of the weapon 10 by screws. Then the weapon 10 can be used already for firing ammunition bodies 20 of smaller caliber. The time required for set up is approximately 15 minutes, so that the weapon 10, when necessary, can be used very quickly also for firing cartridge ammunition bodies 20 of smaller caliber, for example, when any aggressors are located in the area close to the weapon 10 and also are engageable in an effective manner with mortar rounds.

In the illustration according to FIG. 3, an ammunition body 20 has already been placed from above onto the charge cradle 33 of the loading device 30. The ammunition body 20 is located in its feed position outside of the loading chamber 11 of the weapon 10, out of which it can be brought into the firing position by means of the feed slider 31 in the interior of the loading chamber 11, which will be explained below with reference to FIGS. 4 through 9, in which, for better understanding, all of the components of the weapon 10 are not shown.

Figure 4:
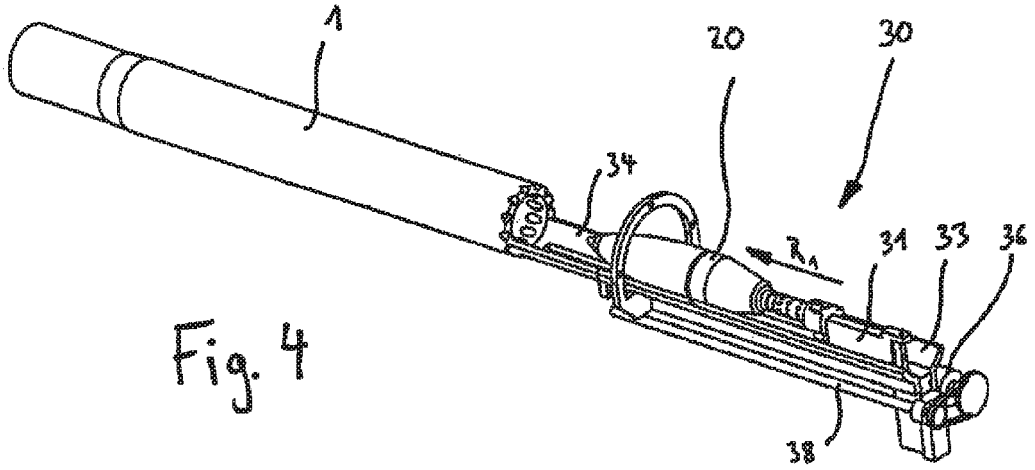
FIGS. 4-10 show different perspective views for illustration of the loading process.

By means of the motorized drive 36, the feed slider 31 and with it, the ammunition body 20, is moved into a first direction designated in FIG. 4 with $R_1$, in the direction of the insertion tube 1. As can be seen from the enlarged illustration in FIG. 5, the charge cradle 33 has a slot 37 in the center, which serves as a guide for the feed slider 31. The movements of the feed slider 31 into the first direction $R_1$, facing in the direction of the tube bore axis of the weapon 10, are affected by the spindle drive 38 that is arranged beneath the charge cradle 33 and connected with the drive 6.

Figure 6:
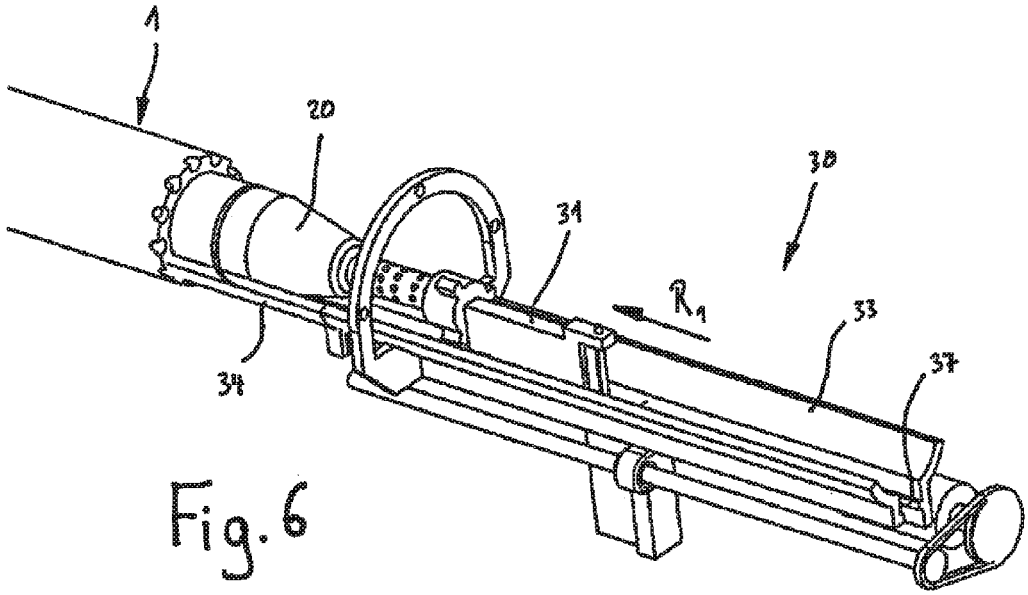

FIG. 6 shows an intermediate position, in which the feed slider 31 already has traveled a short distance in the direction of the insertion tube 1, so that the ammunition body 20 projects partially already into the insertion tube 1. The feed slider 31 is moved via the spindle drive 38 further in the direction $R_1$, until the ammunition body 20 has reached the firing position shown in FIG. 7, in which the ammunition body 20 is inserted completely into the insertion tube 1.

Figure 7:
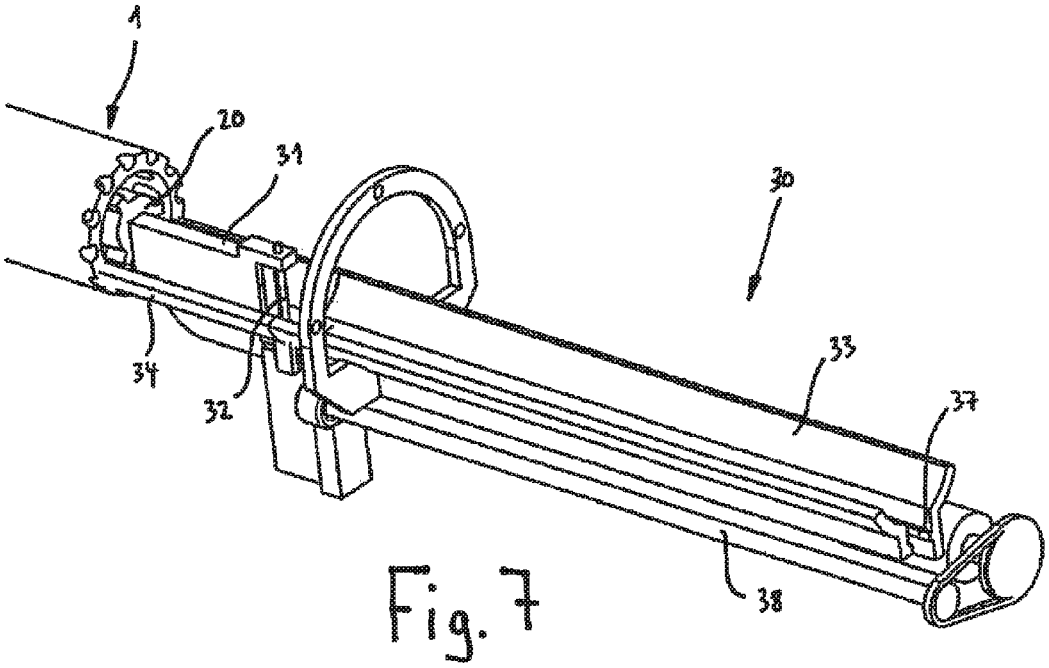
Figure 8:
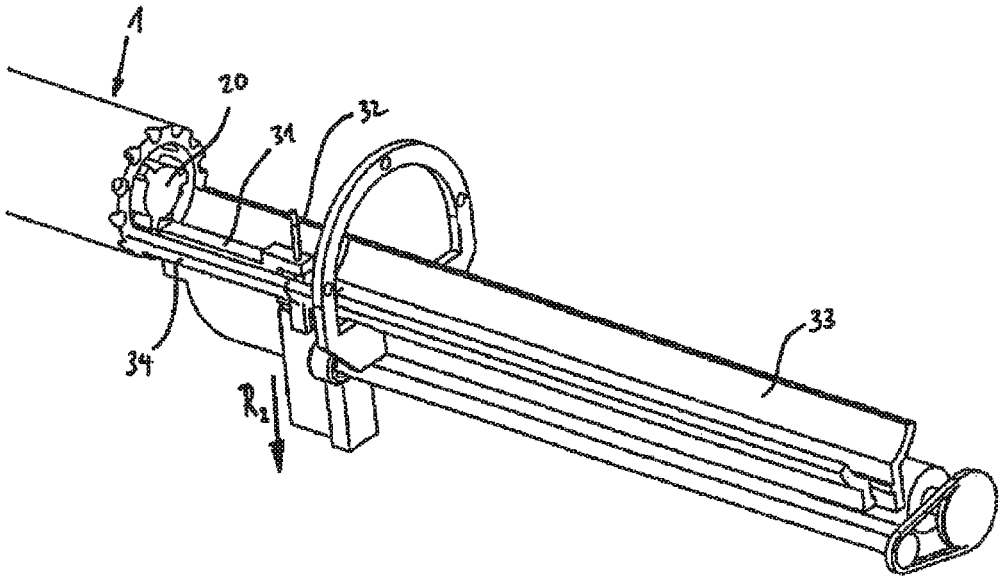
Figure 9:
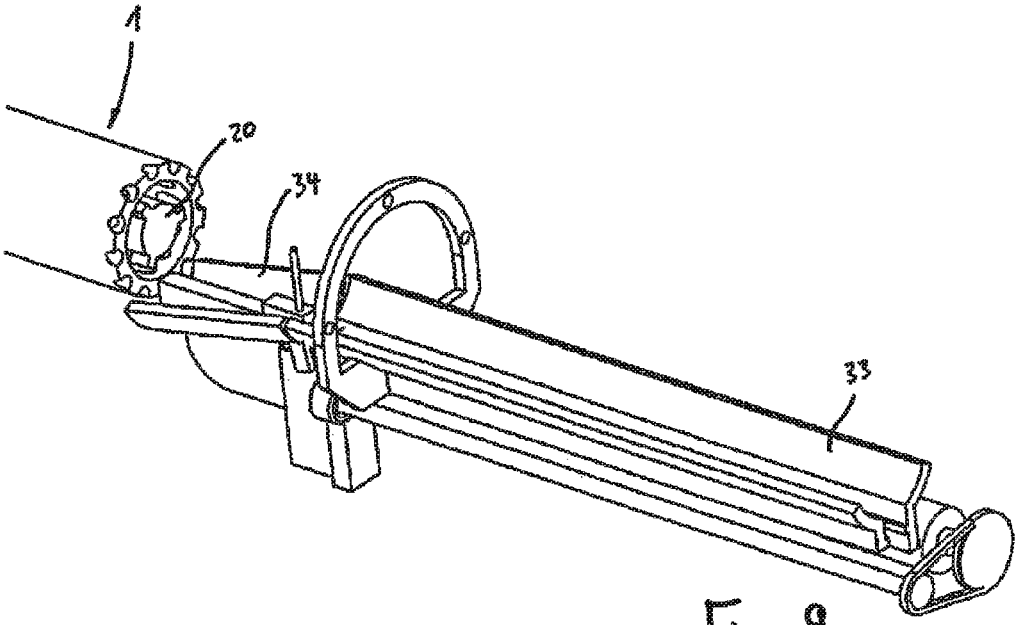

Because specific mortar rounds 20 lie in the upper angle group, that is, which are fired at comparatively large angles of elevation of the weapon 10 and the ammunition body 20 lies loosely in the insertion tube 1, it is necessary that the ammunition body 20 is held in this position via the feed slider 31 in the insertion tube 1 or the weapon 10, as shown in FIG. 7.

In the next step, the closure element 12 of the weapon 10 is locked. The closure element 12 travels from above in the direction of the ammunition body 20 held by the feed slider 31 of the insertion tube 1. At a known position of the closure element 12, this moves on the top into contact with the feed slider 31, whereby this is moved downwardly against the force of a spring into a second direction $R_2$ transverse to the direction of the tube bore axis. According to the exemplary embodiment, the feed slider 31 moves downwardly because of the adjacent closure element 12, whereby the feed slider 31 first contacts the ammunition body 20 and holds it in its firing position. The movement of the feed slider 31 along the second direction is a linear motion, which is carried out via a linear guide 32, which in the exemplary embodiment is formed as a type of bolt guide. The movement of the feed slider 31 takes place against the force of a tensioned spring, so that the feed slider 31 upon opening of the weapon 10, is restored automatically into its upper starting position.

In this manner, first the feed slider 31 is displaced downwardly, whereby the holding function of the feed slider 31 is assumed without interruption by the closure element 12 lying flush above on the feed slider 31.

Upon further closing of the loading chamber 11, the closure element 12 strikes a charge cradle flap 34 linked to a front side of the charge cradle 33. The charge cradle flap 34 lengthens the charging surface of the charge cradle 33 and is pivotally connected with this. Upon contact of the closure element 12 onto the charge cradle flap 33, this also moves downwardly against the force of a spring, so that the closure element 12 can lock the weapon 10 without interruption.

Figure 10:
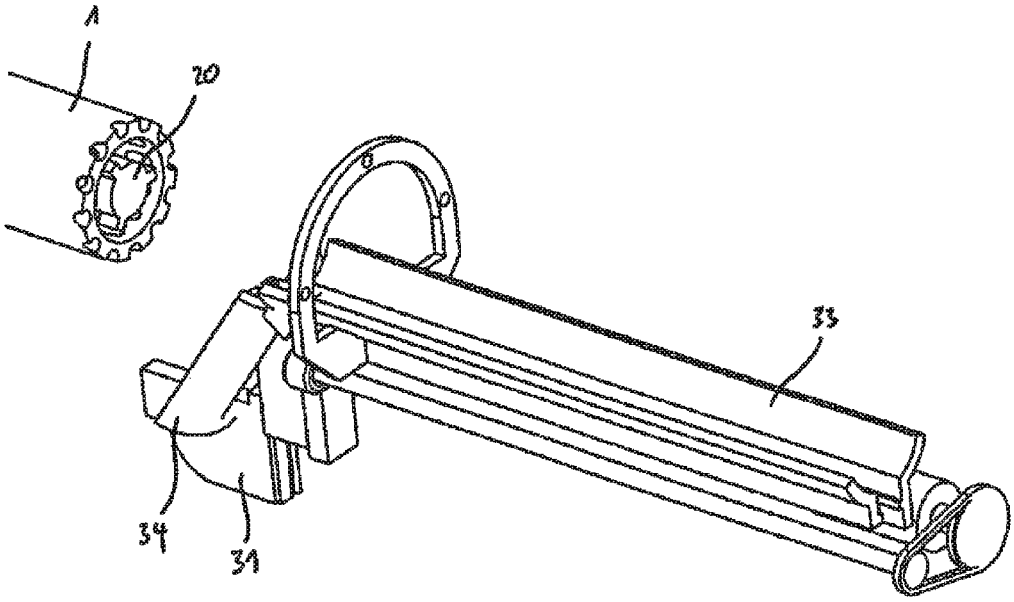

This closure position is shown in FIG. 10 and corresponds essentially to the position described with reference to FIGS. 1 and 2.

In this position, now the firing pin 15 guided through the closure element 12 is accelerated in the direction of the ammunition body 20, whereby this is ignited. The gas pressure formed in the back region of the ammunition body 20 is guided from the interior of the insertion tube 1 via the recesses 3 in the direction of the sealing element 13, so that this provides a reliable sealing between the closure element 12 and the loading chamber 11 of the weapon 10.

With the previously described insertion tube 1 as well as the weapon 10 with the associated loading device 30, subcaliber ammunition bodies 20, such as mortar rounds, can be fired in a simple and safe manner by means of large-caliber weapons, such as a panzer howitzer, for example. The firing of a mortar round, for example, can take place from the protected interior of the howitzer. The set-up time of the weapon amounts to only a few minutes and is practically fail-safe.

The specification incorporates by reference the disclosure of German patent application 10 2011 050 635.7, filed May 26, 2011, as well as International application PCT/DE2012/100150, filed May 22, 2012.

The present invention is, of course, in no way restricted to the specific disclosure of the specification and drawings, but also encompasses any modifications within the scope of the appended claims.

REFERENCE NUMERALS

1 Insertion tube
2 Tube wall
3 Recess
4 Interior
5 Exterior
6 Front face
7 Edge
10 Weapon
11 Loading chamber
12 Closure element
13 Sealing element
14 Firing pin bushing
15 Firing pin
20 Ammunition body
30 Loading device
31 Feed slider
32 Linear guide
33 Charge cradle
34 Charge cradle flap
35 Fastening element
36 Drive
37 Slot
38 Spindle drive
A axis
$\alpha$ angle

The invention claimed is:

1. An insertion tube for firing subcaliber ammunition bodies with a high caliber weapon of a type having a loading chamber, a closure element, and a sealing element that seals the loading chamber against the closure element, the insertion tube comprising:

a tube wall shaped to be inserted into the loading chamber; and the tube wall having a plurality of recesses penetrating therethrough, the recesses being angled to direct pressure from an ignited subcaliber ammunition body within the insertion tube in a direction of the sealing element for compensating pressure differences between the interior of the insertion tube and the loading chamber.

2. The insertion tube according to claim 1, wherein the recesses extend from the inner side of the tube wall radially outward.

3. The insertion tube according to claim 2, wherein the recesses extend at an acute angle relative to a longitudinal axis of the insertion tube.

4. The insertion tube according to claim 1, wherein the recesses extend at least partially into a front face of the tube wall.

5. The insertion tube according to claim 1, wherein the recesses terminate in an edge on the front face of the insertion tube.

6. The insertion tube according to claim 1, wherein the recesses are formed as through-bores.

7. The insertion tube according to claim 1, wherein multiple recesses are distributed symmetrically over a circumference of the tube wall.

8. A weapon, comprising:

a loading chamber, a closure element, and a sealing element that seals the loading chamber against the closure element; and an insertion tube that is insertable into the loading chamber for firing a subcaliber ammunition body, wherein the insertion tube comprises a tube wall having a plurality of recesses penetrating through the tube wall for compensating pressure differences between the interior of the insertion tube and the loading chamber, the recesses being angled to direct pressure from an ignited subcaliber ammunition body within the insertion tube in a direction of the sealing element for compensating pressure differences between the interior of the insertion tube and the loading chamber.

9. The weapon according to claim 8, wherein the loading chamber is closeable via the closure element, the sealing element is arranged between the closure element and the loading chamber, and the sealing element seals the loading chamber relative to the closure element from effects of pressure.

10. The weapon according to claim 9, wherein the recesses extend at an acute angle relative to a longitudinal axis of the insertion tube in a direction of the sealing element.

11. The weapon according to claim 9, wherein the closure element has a firing pin bushing, through which a firing pin can be fed for firing the ammunition body.

12. The weapon according to claim 8, further comprising a loading device for inserting the ammunition body into an interior of the insertion tube inserted in the loading chamber.

13. The weapon according to claim 12, wherein the loading device has a feed slider that is moveable in a direction of the tube bore axis of the weapon for advancing the ammunition body from a feed position into a firing position in the interior of the loading chamber of the weapon.

14. The weapon according to claim 13, wherein the feed slider holding the ammunition body in a firing position is moveable into a second direction.

15. The weapon according to claim 8, wherein the loading chamber is closeable via a closure element, wherein the movements of the feed slider are initiated along the second direction and/or the pivoting motions of a charge cradle flap are initiated by movements of the closure element.

16. An insertion tube for firing subcaliber ammunition bodies with a high caliber weapon of a type having a loading chamber, a closure element, and a sealing element that seals the loading chamber against the closure element, the insertion tube comprising:

a tube wall shaped to fit in flush with the loading chamber along a length thereof; and the tube wall having a plurality of recesses penetrating therethrough, the recesses being angled to direct pressure from an ignited subcaliber ammunition body within the insertion tube onto the sealing element for compensating pressure differences between the interior of the insertion tube and the loading chamber and to achieve a reliable sealing action of the sealing element.

17. The insertion tube of claim 16, wherein the plurality of recesses terminates in a front face of the insertion tube.

18. The insertion tube of claim 17, wherein the plurality of recesses terminates in outer edges of the insertion tube.

19. The insertion tube of claim 16, wherein the plurality of recesses extends at an acute angle relative to a longitudinal axis of the insertion tube.

20. The insertion tube of claim 19, wherein the acute angle is in a range selected from 25° to 35°, 20° to 40°, and 10° to 50°.

* * * * *